United States Patent [19]

del Picchia et al.

[11] 4,279,008

[45] Jul. 14, 1981

[54] RELAY

[76] Inventors: Walter del Picchia, Dept° Eng. e Electricidade - Escola Politecnica - USP - Cidade Universitaria; Wagner W. Martins, Rua Barao de Itauna No. 155; Decio G. Silveira, Rua Urimonduba No. 66, Apt. 92; del Picchia Sergio, Rua das Margaridas No. 26, Apt. 43, all of São Paulo - SP -, Brazil

[21] Appl. No.: 12,770

[22] Filed: Feb. 16, 1979

[30] Foreign Application Priority Data

Aug. 22, 1978 [BR] Brazil ..... 7805413

[51] Int. Cl.[3] ..... H01H 47/04

[52] U.S. Cl. ..... 361/194; 361/208; 361/210

[58] Field of Search ..... 361/186, 194, 167, 168, 361/192, 193, 208, 210; 335/179–182; 363/33

[56] References Cited

U.S. PATENT DOCUMENTS

| | | | |
|---|---|---|---|
| 1,422,625 | 7/1922 | Schwartz | 361/208 X |
| 2,974,260 | 3/1961 | Stimler | 361/167 X |

FOREIGN PATENT DOCUMENTS

| | | | |
|---|---|---|---|
| 607862 | 4/1930 | Fed. Rep. of Germany | 335/180 |

*Primary Examiner*—Harry E. Moose, Jr.

*Attorney, Agent, or Firm*—Beveridge, DeGrandi, Kline & Lunsford

[57] ABSTRACT

An electromagnetic relay comprising an electromagnetic device connectable to a power source, utilized to repel a movable blade and thus separate its movable contact from a fixed contact, driving the blade into another configuration in which it is maintained by a permanent magnet. The current in the energizing circuit of the electromagnetic device flows through the movable contact and through the fixed contact so that when the blade is driven into the second configuration, such energizing circuit is interrupted.

18 Claims, 7 Drawing Figures

FIG. 3
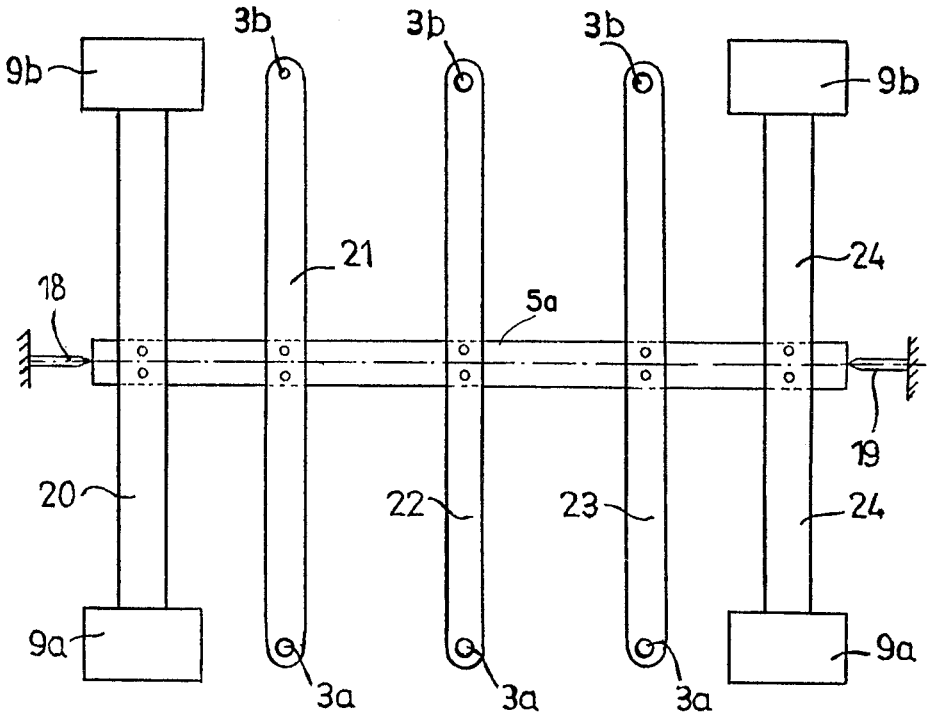
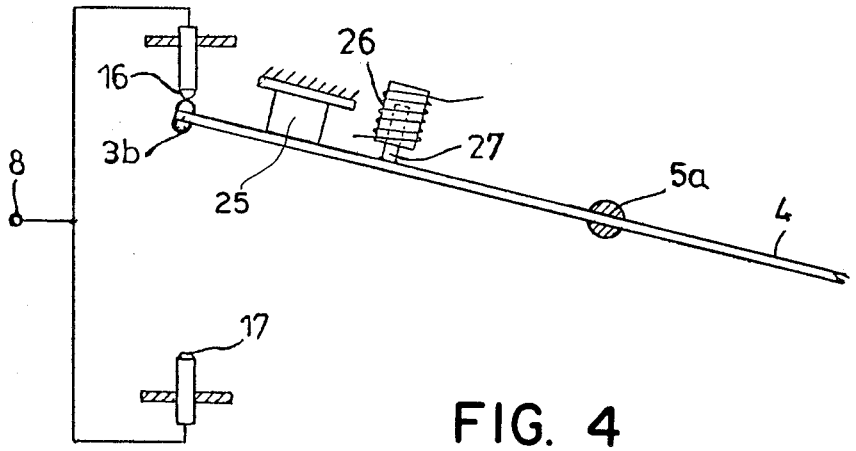
FIG. 4

RELAY

This invention refers to an electromagnetic relay having distinct advantages over the electromagnetic relays previously in use. These usually comprise a blade or arm carrying a movable contact which cooperates with a fixed contact to complete a load circuit when an electromagnetic coil is energized. Evidently it is necessary to have the current flowing continuously through the coil winding to keep the load circuit closed. This means a constant additional power consumption, and many times the use of a separate low voltage circuit to control the relay was found to be more convenient.

Other relays have their coils energized only when it is desired to connect the circuit (for example, by means of a push button), the fixed contact being maintained in the closed circuit position by mechanical means. This type of relay has the disadvantage that when the circuit is connected, and other accidental attempt or defect of the push button or other electric switch controlling the current in the coil results in a constant flow of that current. This frequently burns out the coil which was not designed for a prolonged flow of current. The relay according to this invention combines the advantages and eliminates the disadvantages of the majority of known relays, because it has the following characteristics:

(a) the circuit for controlling or energizing the electromagnetic means used to switch the relay can be connected to the same power supply network (AC or DC) which serves the load or loads being switched;

(b) the relay is maintained in its two positions by means of one or more permanent magnets, which means there is no consumption of electricity, while at the same time mechanical devices such as springs and similar objects are avoided; and (c) when the relay is switched, it is impossible to make the current flow again through the corresponding coil unless the relay first reverts to its initial condition.

In accordance with this invention, a relay having at least one fixed contact, one movable contact mounted on an element capable of assuming a first configuration in which the movable contact is separated from said fixed contact and a second configuration of contact between the movable contact and said fixed contact, first means to make said element assume and maintain said first configuration and second means to make said element assume and maintain said second configuration, is characterized by the fact that said first means comprise a first electromagnetic device to make said element assume the first configuration by means of forces of repulsion or attraction and a permanent magnet to maintain said element in said first configuration by forces of attraction, and the second means comprise a second electromagnetic device to make said element assume the second configuration by means of forces of repulsion or attraction and a permanent magnet to maintain the element in the second configuration by means of forces of attraction, said first electromagnetic device having an energizing circuit comprising the movable contact and said fixed contact.

The invention will now be described in more detail, by way of example, with reference to the attached drawings, in which:

FIG. 3 is a top plan view of a shaft and blade arrangement for use in a modification of the relay shown in FIG. 2;

FIG. 4 is a detail of still another relay constructed in accordance with this invention, showing a different switching system.

Figure 1:
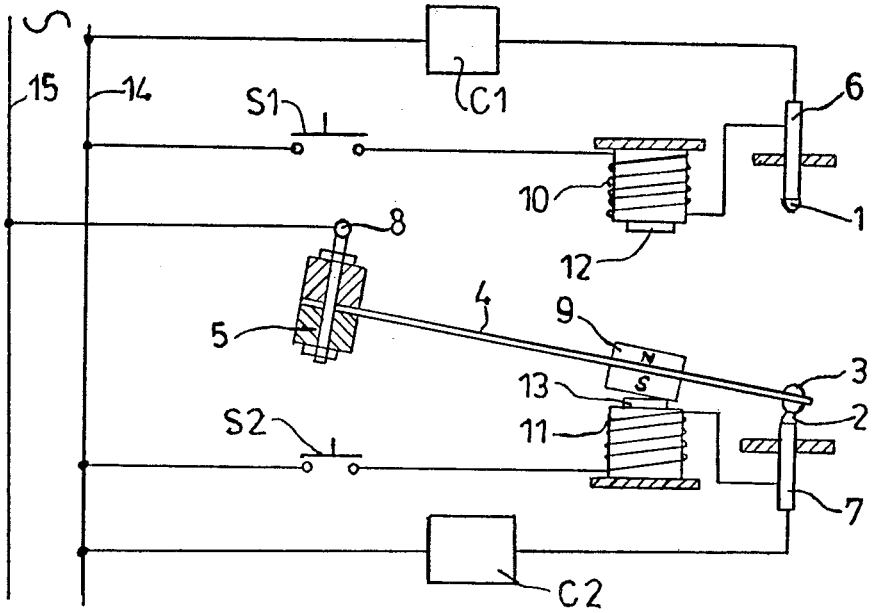
FIG. 1 is a schematic illustration of a relay in accordance with a first embodiment of this invention, including the energizing and load circuits.

Referring now to FIG. 1 of the drawings, a first embodiment of the invention comprises a relay with first and second fixed contacts 1 and 2 and, cooperating with said contacts, a movable contact 3 fixed at the free end of a metal blade 4, mounted in cantilever at 5. The fixed contacts 1 and 2 have terminals 6 and 7 respectively, while a terminal 8, in electrical contact with the supported end of blade 4, serves the movable contact 3. The relay shown in FIG. 1 also has a permanent magnet 9, fixed on blade 4, with a north pole facing the first fixed contact 1 and a south pole facing the second fixed contact 2. Immediately above and below the permanent magnet 9, there are mounted upper and lower fixed coils 10 and 11, with cores 12 and 13 of soft iron or similar material.

When the relay is used, the first terminal 6 is connected through a first load C1 to be switched to a line 14 of the AC power supply network, the second terminal 7 being connected to the same line 14 through a second load C2, which can be an open circuit if switching of only one load is desired. Terminals 6 and 7 are also connected to the respective ends of coils 10 and 11, the other ends of which are connected to line 14 through switches S1 and S2. Terminal 8, which serves the movable contact 3 is, in its turn, connected to the other line 13 of the AC power supply network.

When the relay has the configuration illustrated in FIG. 1, with the movable contact 3 engaged with the second fixed contact 2, the alternating current flows through load C2, the attraction between the permanent magnet 9 and the nucleus of soft iron 13 maintaining blade 4 in this position. The current flows from line 15 to terminal 8, along blade 4, through contacts 3 and 2 and, finally, through load C2 to the other line 14 of the network.

It should be noted that it is of no use to operate switch S1, as this will not complete the circuit that energizes coil 10. By pushing the button of switch S2, however, a circuit is closed from line 15 to line 14, through terminal 8, blade 4 and the contacts 3 and 2, coil 11 and switch S2. The magnetic field then induced in core 13 of coil 11 is an alternating field, so that in the first half cycle of the current in lines 14 and 15 which produces a south pole in the upper end of this core, the permanent magnet 9 (whose south pole faces downwards) is strongly impelled upwardly. When driven upwardly, the magnet 9 will evidently also take blade 4 with it , separating contacts 3 and 2 and disconnecting the current energizing the coil. The upward impulse experienced by permanent magnet 9 causes it to reach core 12 of the upper coil 10 and remain there held by magnetic attraction. This, in turn, causes engagement of contacts 1 and 3 so that the current starts to flow through load C1.

It should again be noted that the described switching will not be affected in any way if the operator continues pressing the push button of switch S2, because one cycle at the most, i.e. up to the first half-cycle that produces a south pole in the upper end 13, is sufficient to interrupt the circuit between contacts 2 and 3. The circuit is, therefore self-protecting.

In order to disconnect load C1 and connect load C2 again, the operation is repeated, except that switch S1 is closed to make blade 4 and the permanent magnet move downward in the first half-cycle of the network which produces a north pole in the bottom end of core 12 of coil 10, until the configuration of FIG. 1 is assumed again.

Figure 2:
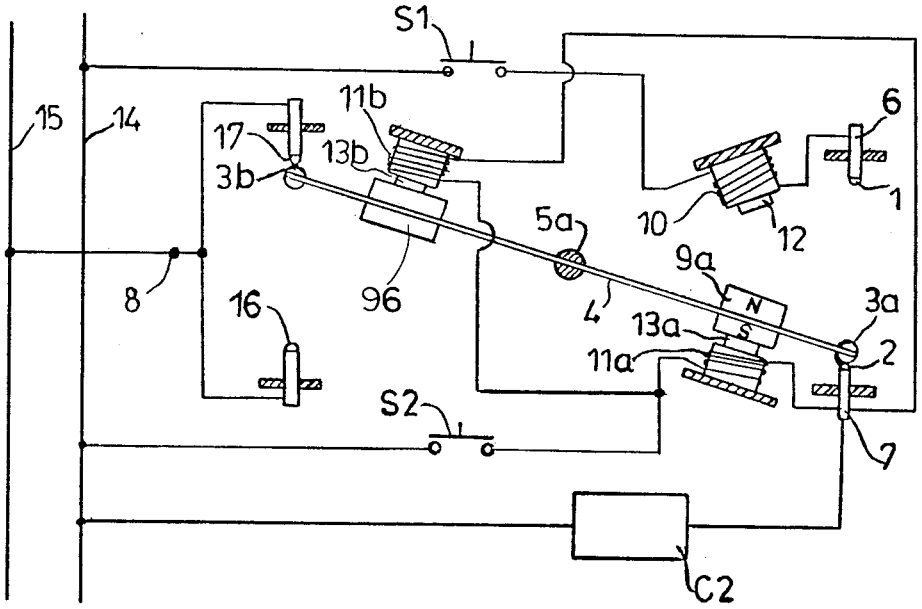
FIG. 2 is similar to FIG. 1, but shows a second embodiment of the invention.

Turning now to FIG. 2, this shows schematically the presently preferred embodiment of the invention. As far as possible, the reference numbers in FIG. 2 are the same as those used in FIG. 1. There are, therefore, first and second contacts 1 and 2 and a movable contact 3*a* cooperating with them. Contact 3*a*, however, is mounted on blade 4 which, instead of being mounted in cantilever as in FIG. 1, is fixed to a rotary shaft 5*a* at the mid-point between its ends. The other end of blade 4 carries a second movable contact 3*b* which cooperates with fixed upper and lower contacts 16 and 17 connected in common to terminal 8.

The relay shown in FIG. 2 was designed for use with only one load C2, for which reason terminal 6 and the fixed contact 1 are only used to define the deactivated position of the relay and to energize coil 12, completing a circuit going from line 14, through switch S1, coil 12, terminal 6, contacts 1 and 3*a*, blade 4, contacts 3*b* and 16 and terminal 8, to line 15. Since there is no danger of the contacts getting welded in the position of C2 disconnected, one relatively small coil 12 is sufficient. If, however, the relay is deactivated when heavy currents flow through load C2, it has proved desirable to use two coils 11*a* and 11*b* with their respective soft iron cores 13*a* and 13*b*. These coils are connected in parallel between switch S2 and fixed contact 7. For this reason, there are also two permanent magnets 9*a* and 9*b*, so that when switch S2 is closed, the relay switches in the first half-cycle that induces a south pole in the upper end of core 13*a* and a north pole in the lower end of core 13*b*. Care should be taken, of course, to check that the coils 11*a* and 11*b* are properly connected so that this occurs in the same half-cycle.

Although FIG. 2 shows the permanent magnets 9*a* and 9*b* mounted on the same blade as the movable contacts 3*a* and 3*b*, it is to be understood that another actuating blade suitable to turn the shaft 5*a* at a desired angle could be used, and even simplify the structure. By way of example, FIG. 3 shows a plan view of a shaft and blade arrangement. In this case, the shaft 5*a*, of isolating material, is mounted for rotation between centers 18 and 19. Five parallel blades 20, 21, 22, 23 and 24 are mounted transversally on the shaft. Blades 21, 22 and 23 carry at each end movable contacts 3*a* and 3*b*, as in FIG. 2, whereas the outermost blades 20 and 24 are actuating blades carrying permanent magnets 9*a* and 9*b*. These magnets work in cooperation with coils similar to those of FIG. 2, always remembering that one end of each coil should be connected to one or more of the fixed contacts (not shown in FIG. 3). In this embodiment there are, therefore, four magnets, two smaller coils (equivalent to coil 10 in FIG. 2) and four bigger coils (equivalent to coils 11*a* and 11*b* in FIG. 2).

All the relays described with reference to FIGS. 1 to 3 have the characteristic of a permanent magnet on the blade, which cooperates with an energized coil for repulsion and with the core of a non-energized coil, for attraction. It should be understood, however, that other ways do exist of obtaining the same effect and that FIG. 4 is a detail of an alternative for the system, for example, of FIG. 2.

With reference now to FIG. 4, the permanent magnet 9*b* and the coil 11*b* of FIG. 2 are substituted by a fixed magnet 25 and a solenoid 26. Blade 4, in its turn, has a tooth 27 of soft iron which functions as a movable core and enters solenoid 26 in the configuration shown. The solenoid is connected in a manner identical to that of coil 11*b* of FIG. 2. When the solenoid is not energized, the metal of the blade 4 itself is attracted by the permanent magnet 25, maintaining the contacts 3*b* and 16 closed. When the solenoid is energized and in the first half of the cycle of the network current that produces such effect, tooth 27 is expelled from its interior, disconnecting contacts 3*b* and 16 and driving blade 4 to assume the other configuration where it will be held by another fixed permanent magnet (not shown) similar to magnet 25.

Figure 5:
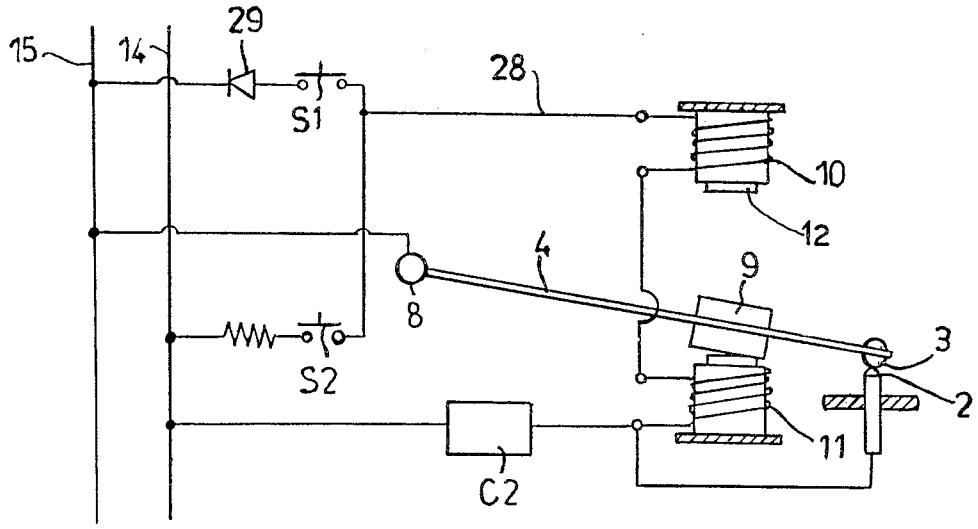
FIGS. 5, 6 and 7 show schematically three other embodiments of this invention, similar to the one shown in FIG. 1, but with different energizing circuits.

With reference now to FIG. 5, the circuit illustrated is basically similar to the one shown in FIG. 1, except that there is only one fixed contact 2 with only one load C2 and the connections of coils 10 and 11 are different. In the case of FIG. 5, the two coils 11 and 10 are connected in series between the fixed contact 2 and a line 28. The first end of the coil 11 is connected to the fixed contact 2 and line 28 can be connected to the phase line 15 through the switch S1 and a rectifier 29. Line 28 can also be connected to the neutral line 14 by means of switch S2 and a resistor. In the position shown in FIG. 5 load C2 is connected with current flowing through the arm 4 and contacts 2,3. On closing switch S2, the coils 10 and 11 are connected in series between lines 14 and 15 by means of a circuit including arm 4 and contacts 2,3 of the relay. In the first cycle that induces a magnetic field in core 13 of coil 11, to repel the permanent magnet 9, arm 4 is driven upward, cutting said circuit, so as to make magnet 9 assume a position in contact with core 12 of coil 10.

When it is desired to connect the circuit again, it is only necessary to press switch S1. A current polarized by rectifier 29 now flows through line 15, through coils 10 and 11 and through load C2. The coils 10 and 11 are wound so that the polarized current flowing in coil 10 repels magnet 9, while this same polarized current flowing through coil 11 attracts it. When contacts 10, 2 and 3 are disconnected normally, i.e. when the magnet 9 is in contact with core 13, even if switch S1 remains closed, the current stops flowing in the coils because they are by-passed by arm 4 of the relay, whose terminal 8 is also connected to the phase line 15.

Figure 6:
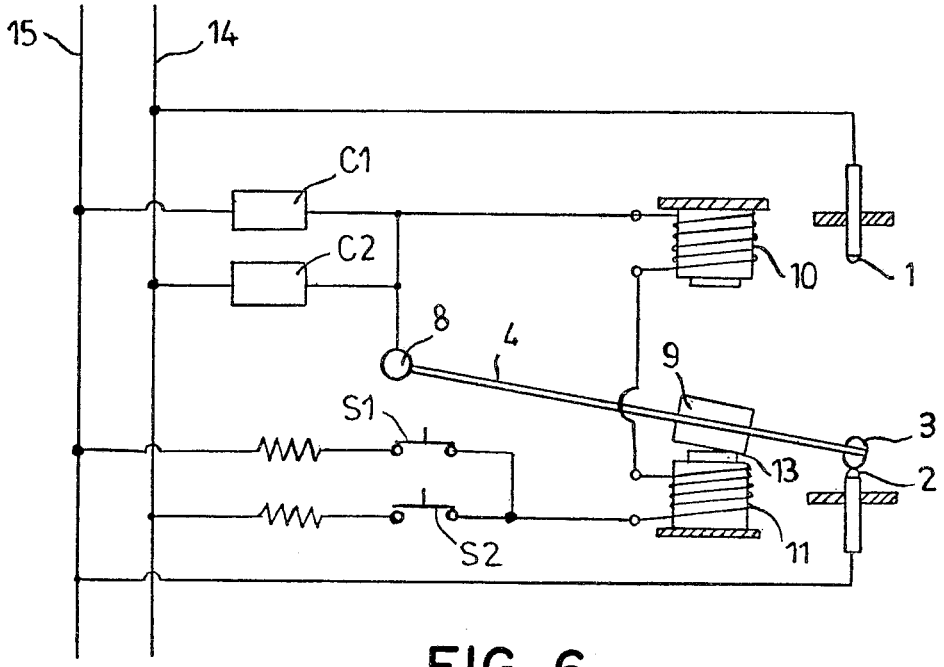

The relay shown in FIG. 6 is also similar to the one shown in FIG. 1, but has different controls and connections. In this case, terminal 8 in the pivot of arm 4 is connected to the two lines 14 and 15 of the supply through the two loads C2 and C1, respectively. The two coils 10 and 11 are connected in series between, on the one hand, terminal 8, and on the other, switches S1 and S2, whose terminals are connected to lines 15 and 14 respectively through appropriate resistors. In the illustrated position load C2 is connected, but load C1 is not, since its two sides are connected through arm 4 of the relay to the same line 15 of the network. When switch S2 is pressed, current flows from line 14 through switch S2 and through the coils 11 and 10 in series, along arm 4 and through contacts 3 and 2 to the line 15. With the first half cycle that induces a magnetic field in the core 13 of coil 11 to repel the permanent magnet 9, arm 4 is driven upwards until the movable contact 3 meets fixed contact 1. In this configuration, the terminal 8 and the arm 4 are connected directly to line 14 so that even in the hypothesis that switch S2 remains closed, no current can pass directly through coils 10 and 11. In this second position, therefore, the load C2 is disconnected and load C1 is connected between lines 14 and 15 by means of a circuit including arm 4 and the fixed contact 1. When the switch S1 is pressed, an identical operation takes place in contrary direction.

Figure 7:
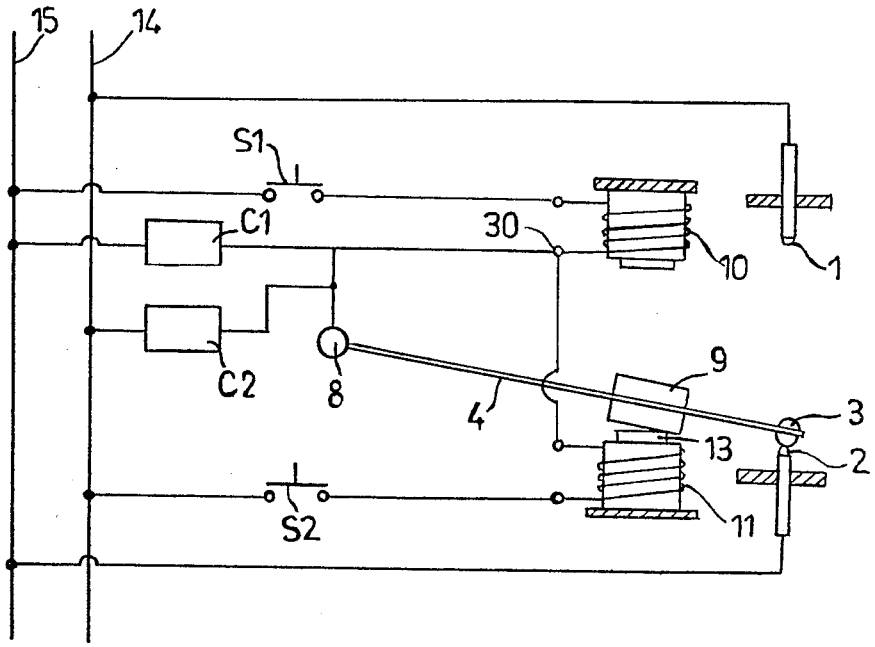

FIG. 7 shows still another possibility of making the connection of the relay of FIG. 1. In this case the coils 10 and 11 are also connected in series between the lines 14 and 15, but a tap at 30 between the two coils is connected to terminal 8, so that in the configuration with load C2 connected, as illustrated, the actuation of the switch C2 connects only coil 11 in a circuit going from line 14, through switch 22, the coil itself 11, the tap 30, the terminal 8 and the fixed and movable contacts 2, 3, to the line 15. When arm 4 is driven upwardly, the coil 11 energizing circuit is cut again and when contact 3 assumes its other configuration against the fixed contact 1, switch S2 is of no more effect. In such configuration, of course, load C1 is connected, but can be disconnected again by the switch S1 functioning in a way similar to that described with reference to load C2.

Although the circuits illustrated in FIGS. 1, 5, 6 and 7 have two loads C1 and C2, it is evident that one of the loads is merely optional and can be eliminated without modifying the function of the relay.

Although the relays constructed in accordance with this invention are destined mainly for use in AC systems where the switching power is supplied by the main supply itself, they can also be used in DC systems, except that in this case, it is essential to check the polarities and the directions winding of the coils to ensure repulsion between the magnets and the cores when the corresponding coils are energized.

Finally, those skilled in the art will understand that many modifications and adaptations of the relays described herein could be made with no detriment to the spirit of the present invention, whose only limitation is imposed by the scope of the attached claims.

We claim:

1. A relay comprising at least one fixed contact, one movable contact mounted on an element capable of assuming a first configuration in which the movable contact is separated from said fixed contact and a second configuration of contact between the movable contact and said fixed contact, first means to make said element assume and maintain said first configuration and second means to make said element assume and maintain said second configuration, characterized by the fact that said first means comprise a first electromagnetic device to make said element assume the first configuration by means of forces of repulsion and a permanent magnet so as to maintain said element in the first configuration by means of forces of attraction and the second means comprise a second electromagnetic device to make said element assume the second configuration by means of forces of repulsion and a permanent magnet to maintain the element in the second configuration by means of forces of attraction, said first electromagnetic device having an energizing circuit comprising the movable contact and the mentioned fixed contact.

2. A relay in accordance with claim 1, characterized by the fact that each electromagnetic device comprises a fixed coil containing in its interior a nucleus of ferromagnetic material, preferably soft iron.

3. A relay in accordance with claim 1, characterized by the fact that said element comprises a metal blade which carries said movable contact at one of its ends, said first and second electromagnetic devices being aligned with each other on opposite sides of said blade and between the ends thereof.

4. A relay in accordance with claim 3, characterized by the fact that a single permanent magnet is common to said first and second means, being used for maintaining the blade in each one of said configurations, said magnet being aligned with said electromagnetic devices to accompany the displacement of the blade between the two configurations, one magnetic pole facing the first electromagnetic device and the other pole facing the other electromagnetic device.

5. A relay in accordance with any one of the claims 1 to 4, comprising a second fixed contact which is engaged by the movable contact in the first configuration, characterized by the fact that the second electromagnetic device has an energizing circuit comprising the movable contact and the first fixed contact.

6. A relay in accordance with claim 5, characterized by the fact that one end of the winding of the first coil is connected to the first fixed contact, its other end being connectable to one side of the power supply network, serving as a source of supply for a load to be controlled by the relay, while one end of the second coil is connected to the second fixed contact, its other end being connectable to the same said side of the network.

7. A relay in accordance with claim 3 or 4, characterized by the fact that said blade is mounted in cantilever at the opposite end to that having the movable contact, the blade having a terminal at its fixed end.

8. A relay in accordance with claim 4, characterized by the fact that said magnet is mounted on the blade.

9. A relay in accordance with claim 3 or 4, characterized by the fact that said blade is freely pivoted about a fixed point.

10. A relay in accordance with claim 9, characterized by the fact that said pivot point is along the length of said blade which is equipped with a second movable contact at one opposite end to the first movable contact, said relay also comprising third and fourth movable contacts in the first and second configurations, respectively, which are determined by two angular positions of pivoting of said blade.

11. A relay in accordance with claim 10, characterized by the fact that said and fourth fixed contacts are both connected to a terminal to be connected to a power supply network which supplies both the load or loads being controlled by the relay and the energizing circuits of the electromagnetic devices.

12. A relay in accordance with claim 10, characterized by the fact that said pivot point is determined by a transverse shaft means on which the referred plate is mounted, at least one separate actuating blade carrying said permanent magnet being mounted transversely on said shaft means in association with said electromagnetic devices.

13. A relay in accordance with claim 12, characterized by the fact that said actuating blade has a permanent magnet mounted on each of its ends, said first electromagnetic device comprising two coils with respective ferromagnetic nuclei, mounted permanently on the opposite sides of the actuating blade, at its opposite ends, for cooperating with the referred permanent magnets, respectively.

14. A relay in accordance with claim 13, characterized by the fact that each one of said two coils has one end of its winding connected to the second fixed contact and its other end connectable to one side of the power supply network.

15. A relay in accordance with claim 10, characterized by the fact that each one of said means for making said blade assume and maintain the first or second configuration respectively, comprises a fixed solenoid, a movable nucleus and a permanent magnet, said movable nucleus being mounted so as to accompany the movement of said plate and said permanent magnet cooperating, in the respective configuration, with a metallic part which also accompanies the movement of said blade.

16. A relay in accordance with claim 11, characterized by the fact that said pivot point is determined by a transverse shaft means on which the referred plate is mounted, at least one separate actuating blade carrying said permanent magnet being mounted transversely on said shaft means in association with said electromagnetic devices.

17. A relay in accordance with claim 11, characterized by the fact that said actuating blade has a permanent magnet mounted on each of its ends, said first electromagnetic device comprising two coils with respective ferromagnetic nuclei, mounted permanently on the opposite sides of the actuating blade, at its opposite ends, for cooperating with the referred permanent magnets, respectively.

18. A relay in accordance with claim 2, characterized by the fact that said element comprises a metal blade which carries said movable contact at one of its ends, said first and second electromagnetic devices being aligned with each other on opposite sides of said blade and between the ends thereof.

* * * * *